US009228736B1

(12) United States Patent
Austin

(10) Patent No.: US 9,228,736 B1
(45) Date of Patent: Jan. 5, 2016

(54) ARTICLE OF PROTECTIVE CLOTHING WITH LIGHT SOURCE

(71) Applicant: Scott Austin, Tewksbury, MA (US)

(72) Inventor: Scott Austin, Tewksbury, MA (US)

( * ) Notice: Subject to any disclaimer, the term of this patent is extended or adjusted under 35 U.S.C. 154(b) by 0 days.

(21) Appl. No.: 14/340,341

(22) Filed: Jul. 24, 2014

Related U.S. Application Data

(63) Continuation-in-part of application No. 14/268,329, filed on May 2, 2014.

(60) Provisional application No. 61/818,742, filed on May 2, 2013.

(51) Int. Cl.

| | |
|---|---|
| ***F21V 21/08*** | (2006.01) |
| ***F21V 33/00*** | (2006.01) |
| ***A43B 23/24*** | (2006.01) |
| ***A62B 17/00*** | (2006.01) |
| ***A43B 13/00*** | (2006.01) |
| ***A43B 7/34*** | (2006.01) |
| ***F21V 21/084*** | (2006.01) |
| ***F21V 25/12*** | (2006.01) |
| ***F21V 31/00*** | (2006.01) |

(52) U.S. Cl.
CPC ..... *F21V 33/0076* (2013.01); *A43B 7/34* (2013.01); *A43B 13/00* (2013.01); *A43B 23/24* (2013.01); *A62B 17/003* (2013.01); *F21V 21/084* (2013.01); *F21V 25/12* (2013.01); *F21V 31/00* (2013.01); *F21V 33/0008* (2013.01)

(58) Field of Classification Search
CPC ..... F21V 33/0076; F21V 21/084; F21V 33/0008; F21V 25/12; F21V 31/00; F21V 33/00; F21V 33/0004; A43B 23/24; A43B 13/00; A43B 7/34; A43B 3/001; A62B 17/003; F21L 4/00; A41D 13/01
USPC ..... 362/103, 105, 106, 108, 157, 158, 190; 36/137
See application file for complete search history.

(56) References Cited

U.S. PATENT DOCUMENTS

| | | | | |
|---|---|---|---|---|
| 5,309,571 | A * | 5/1994 | Huang | A62B 17/003 2/458 |
| 5,720,121 | A | 2/1998 | Barker | |
| 7,059,070 | B2 * | 6/2006 | Omstead et al. | 36/137 |
| 2002/0085372 | A1 * | 7/2002 | Lehrer | 362/105 |
| 2008/0019119 | A1 * | 1/2008 | Marston | 362/103 |
| 2010/0183805 | A1 * | 7/2010 | Nieminen | 427/162 |
| 2012/0033411 | A1 * | 2/2012 | Heo | 362/108 |
| 2012/0171409 | A1 * | 7/2012 | Todt et al. | 428/90 |
| 2012/0262909 | A1 * | 10/2012 | Campman | 362/102 |
| 2014/0268683 | A1 * | 9/2014 | Waters | 362/106 |

* cited by examiner

*Primary Examiner* — Anh Mai
*Assistant Examiner* — Glenn Zimmerman
(74) *Attorney, Agent, or Firm* — Lisa M. Warren, Esq.; Morse, Barnes-Brown & Pendlton, P.C.

(57) ABSTRACT

An article of protective clothing, such as a boot, for providing visibility to a wearer has at least one light source encased within a housing. The housing is integrated within the article of protective clothing. The article of protective clothing includes a light-permeable shield positioned over the encased light source in the housing. Also, the article of protective clothing has a power source functionally coupled to the light source. The shield has one or more protective properties equal to or greater than one or more protective properties of the protective clothing.

29 Claims, 9 Drawing Sheets

ARTICLE OF PROTECTIVE CLOTHING WITH LIGHT SOURCE

RELATED APPLICATIONS

This application is a continuation-in-part of U.S. application Ser. No. 14/268,329, filed May 2, 2014, which claims the benefit of U.S. Provisional Application No. 61/818,742, filed May 2, 2013. The entire teachings of the above applications are incorporated herein by reference.

BACKGROUND OF THE INVENTION

Articles of protective clothing are generally useful to police officers, construction workers, soldiers, miners, and firefighters. Various technologies are being developed for articles of protective clothing to make such jobs safer by minimizing inherent dangers.

For example, firefighters work under some of the most extreme conditions, placing them at a high risk of injury or death. One area of constant modification and advancement is a firefighter's personal protective equipment (PPE). A PPE includes pants, coat, helmet, gloves, boots, hood, and a breathing apparatus. Each component is designed specifically for firefighters and their specific work environment. There are also many tools that a firefighter typically carries such as a bright flashlight.

Visibility can be a major factor in the safety and effectiveness of a firefighter. Although firefighters often carry flashlights, the flashlights alone do not illuminate the entire area around the firefighter. Moreover flashlights can be displaced in an emergency situation, significantly decreasing the visibility of a firefighter to rescue and other safety personnel. Thus, conventional articles of protective clothing do not offer an adequate solution to render wearers readily visible to third parties.

SUMMARY OF THE INVENTION

In accordance with an embodiment of the present invention, an article of protective clothing for providing visibility of a wearer has at least one light source encased within a housing. The housing is integrated within (e.g., encased in, molded into) the article of protective clothing, and, in some embodiments, is removable for repair or replacement of the light source or housing. The article of protective clothing also includes a light-permeable shield positioned over the encased light source in the housing. Also, the article of protective clothing has a power source functionally coupled to the light source. The shield has one or more protective properties equal to or greater than one or more protective properties of the protective clothing. In some embodiments the light source contained within the housing meets or exceeds the NFPA 1971-8.6 standards with regard to heat and/or water resistance.

In accordance with aspects of the present invention, the light source emits light of at least one color including, but not limited to, red, white, blue, green and yellow. In an alternative embodiment, the light source emits light of more than one color.

In accordance with aspects of the present invention, the one or more protective properties are selected from the group consisting of water resistance, fire resistance, and impact resistance.

In accordance with aspects of the present invention, the power source is a battery. In a further embodiment, the battery is a lithium battery or an alkaline battery. In another further embodiment, the battery is a rechargeable battery. In another embodiment the power source is wirelessly rechargeable.

In accordance with aspects of the present invention, the article of protective clothing has an actuator for the power source.

In accordance with aspects of the present invention, the shield material exhibits fire resistant properties and transparency/translucence. In an embodiment of the present invention, the shield comprises apolycarbonate lens. In another embodiment of the present invention, the shield is a glass such as a borosilicate. In another embodiment of the present invention, the shield has a thickness between about 2 millimeters and 10 millimeters, preferably between about 2 millimeters and about 4 millimeters.

In an embodiment of the present invention, the shield is coated with a protective coating. In another embodiment, the coating provides thermal resistance properties and mechanical properties such as scratch resistance to the shield. In one embodiment, the shield is coated with asiloxane-based acrylate material. In another embodiment the shield is removable for repair or replacement.

In accordance with aspects of the present invention, the light source is a light emitting diode (LED). In another embodiment, the light source is a strobe light. In another embodiment the light source can be actuated remotely, such as with a fob or other hand-held device. In another embodiment the light source is co-actuated with one or more other devices, for example such as an SCBA in the case of a firefighter; that is, activating one of the co-actuated devices results in activation of the other.

In accordance with aspects of the present invention, the light source is configured to emit an amount of light of at least about 10 lumen, and in certain embodiments at least about 80 lumen. In an alternative embodiment, the light source is configured to emit an amount of light of at least about 200 lumen. The amount of light emitted may vary depending on power source and length of run time (e.g., battery life). In particular aspects the light source comprises multiple (e.g., 1, 2, 3, etc.) light pods 22, each of which emits an amount of light of at least about 10 lumen.

In accordance with aspects of the present invention, the article comprises multiple light sources.

In accordance with aspects of the present invention, the light source is located within a back section of the article of protective clothing relative to the use of the article of protective clothing.

In accordance with aspects of the present invention, the power source is located within the article of protective clothing and remote from the light source.

In accordance with aspects of the present invention, the article of clothing is selected from the group consisting of footwear, headwear, and outerwear. In another embodiment, the article of clothing is a boot or shoe. In another embodiment, the article of clothing is a glove. In some embodiments the article of clothing meets or exceeds the NFPA 1971-8.6 standards with regard to heat and/or water resistance.

In accordance with aspects of the present invention, the light source emits light in a temporal or spatial pattern (e.g., flashing, blinking, escalating, strobing, constant etc.).

In accordance with aspects of the present invention, the light source is encased such that it is water resistant. In another embodiment, the light source is encased such that it is watertight. In certain embodiments the housing and/or the shield can be removable for repair or replacement.

In accordance with aspects of the present invention, the article comprises multiple encased light sources, each of which is located at an independent location.

In accordance with an embodiment of the present invention, a boot for providing visibility of a wearer has at least one light source encased within a housing. The housing is integrated, encased or molded into the boot (e.g., into the sole, such as a vulcanized rubber outsole). The boot includes a light-permeable shield positioned over the encased light source in the housing. Also, the boot has a power source functionally coupled to the light source. The shield has one or more protective properties equal to or greater than one or more protective properties of the protective clothing.

In accordance with aspects of the present invention, the housing is integrated within the heel or outsole of the boot. In an alternative embodiment, the housing is integrated within the toe of the boot. The housing can be positioned on the rear and/or front of the outsole, and/or offset to one or both sides. Alternatively or additionally the light source and housing can be positioned on the bottom of the sole of the boot.

In accordance with aspects of the present invention, the boot comprises multiple light sources each encased within a housing. In a further embodiment, at least one housing is integrated within the heel of the boot and at least one housing is encased within the toe of the boot.

BRIEF DESCRIPTION OF THE DRAWINGS

These and other characteristics of the present invention will be more fully understood by reference to the following detailed description in conjunction with the attached drawings.

The patent or application file contains at least one drawing executed in color. Copies of this patent or patent application publication with color drawings will be provided by the Office upon request and payment of the necessary fee.

DETAILED DESCRIPTION OF THE INVENTION

Figure 1:
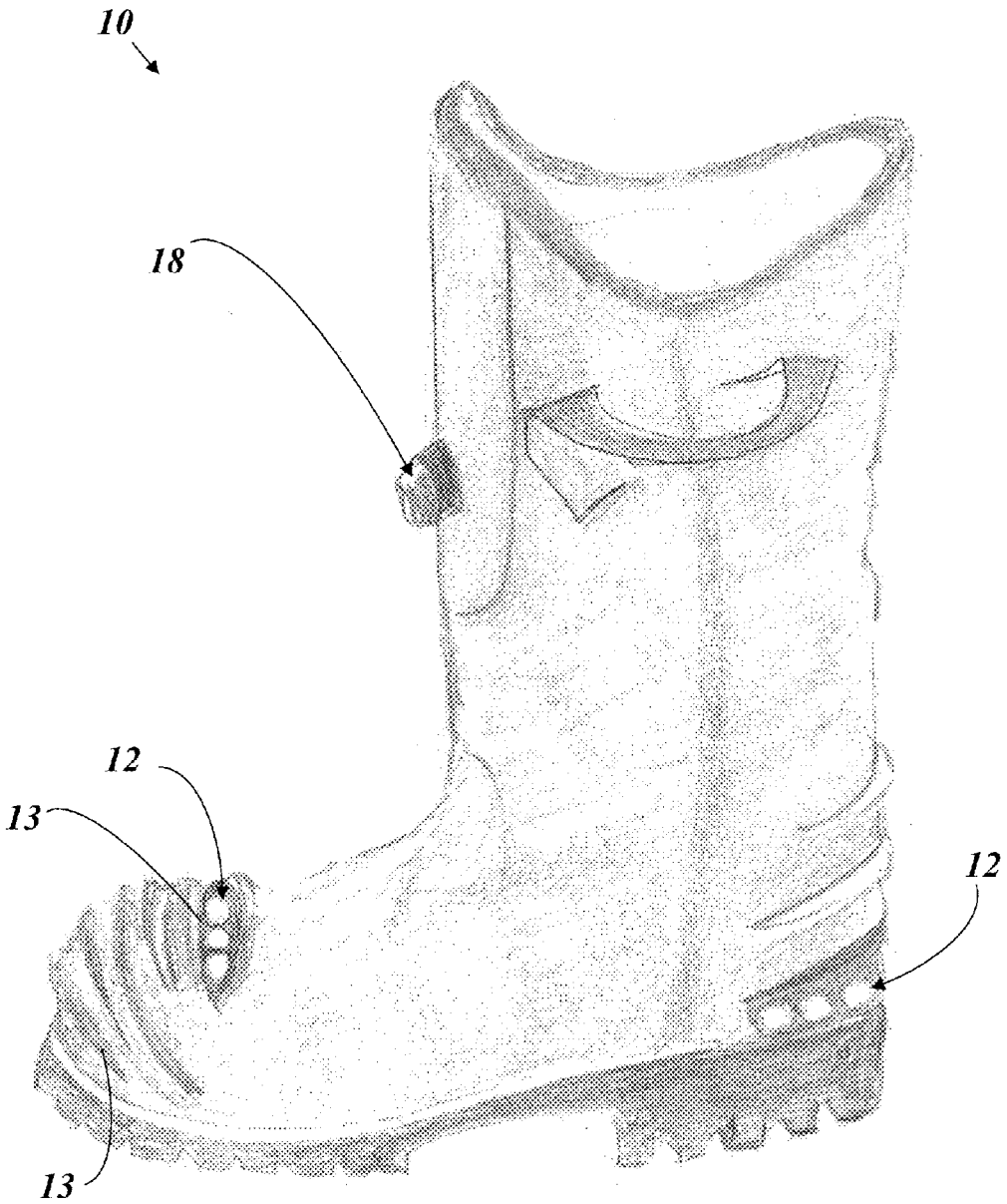
FIG. 1 is a perspective view of an article of protective clothing according to an embodiment of the present invention.

An illustrative embodiment of the present invention relates to an article of protective clothing of a wearer. In particular, the article of protective clothing may be a boot for providing visibility of a wearer.

FIGS. 1 through 6, wherein like parts are designated by like reference numerals throughout, illustrate example embodiments of an article of protective clothing such as a boot according to the present invention. Although the present invention will be described with reference to the example embodiments illustrated in the figures, it should be understood that many alternative forms can embody the present invention. One of skill in the art will additionally appreciate different ways to alter the parameters of the embodiments disclosed, such as the size, shape, or type of elements or materials, in a manner still in keeping with the spirit and scope of the present invention.

Figure 2:
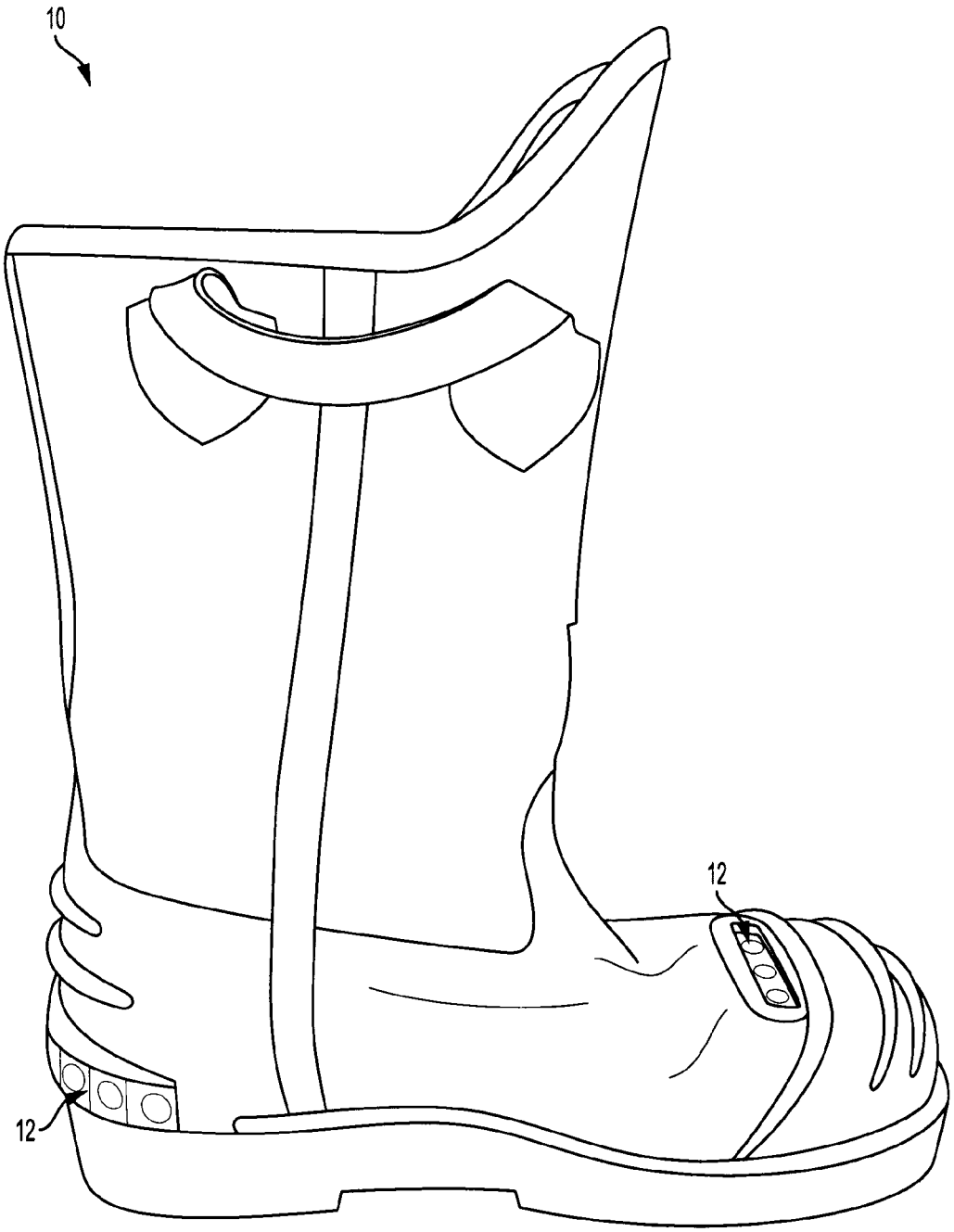
FIG. 2 is a photographic side view of an article of protective clothing according to an embodiment of the present invention.
Figure 3:
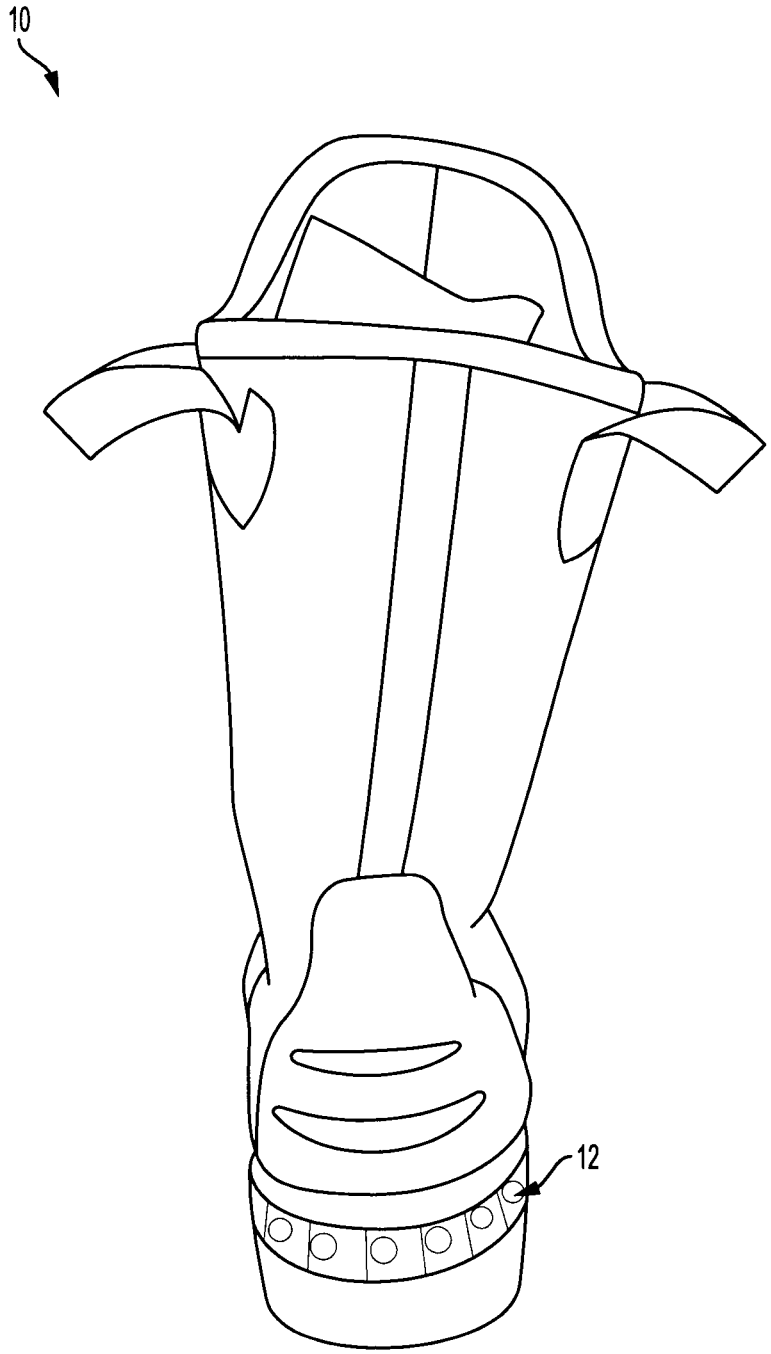
FIG. 3 is a photographic back view of the article of protective clothing in FIG. 2 according to an embodiment of the present invention.

Referring now to FIGS. 1-3, an article of protective clothing 10 such as a boot for providing visibility to a wearer is depicted according to an example embodiment of the present invention.

The article of protective clothing 10 may be footwear, headwear, or outerwear. In particular, the footwear may be a boot or shoe. The outerwear may be a coat and the headwear may be a helmet. However, one of skill in the art may appreciate other articles of protective clothing that may be more appropriate within the scope of the present invention. In this example, the article of protective clothing 10 is a boot.

The article of protective clothing 10 such as a boot includes at least one light source 12. The article of protective clothing 10 may include multiple light sources 12. In this example, as shown in FIGS. 1-3, the article of protective clothing 10 includes two light sources 12.

In one example, at least one light source 12 is located within a back section of the article of protective clothing 10 relative to the use of the article of protective clothing 10. In another example, the article of protective clothing 10 includes multiple encased light sources 12 each located at an independent location.

Each light source 12 is encased within a housing. The housing is integrated within the article of protective clothing 10 such as the boot. In one example, the light source 12 is encased or enclosed such that it is water resistant or specifically watertight.

In FIGS. 1-3, the housing encasing one of the light sources 12 is integrated within the heel of the article of protective clothing 10 specifically a boot. A second light source 12 is integrated within the toe of the article of protective clothing 10 specifically a boot. In particular, the light source 12 can be integrated within rubber protective ribs 13 of the boot.

In one example, the light source 12 emits light of at least one color (i.e., single color). For example, the light source 12 is a switchable single color light source. Alternatively, in another example, the light source 12 emits light of more than one color (i.e., multicolor). In particular, the one or more colors may include red, white, blue, green and yellow. In another example, the light source emits light in a temporal or spatial pattern. Other examples include the light source emitting light as steady, flashing, and multi-pattern.

In one example, the light source 12 is a light emitting diode (LED). For example, the light source 12 includes one or more bright high lumen white LED lights. In an alternative example, the light source is a strobe light.

In one example, the light source 12 is configured to emit an amount of light of at least about 10, 20, 30, 40, 50, 60, 70 or 80 lumen. In an alternative example, the light source 12 is configured to emit an amount of light of at least about 200 lumen.

Figure 4:
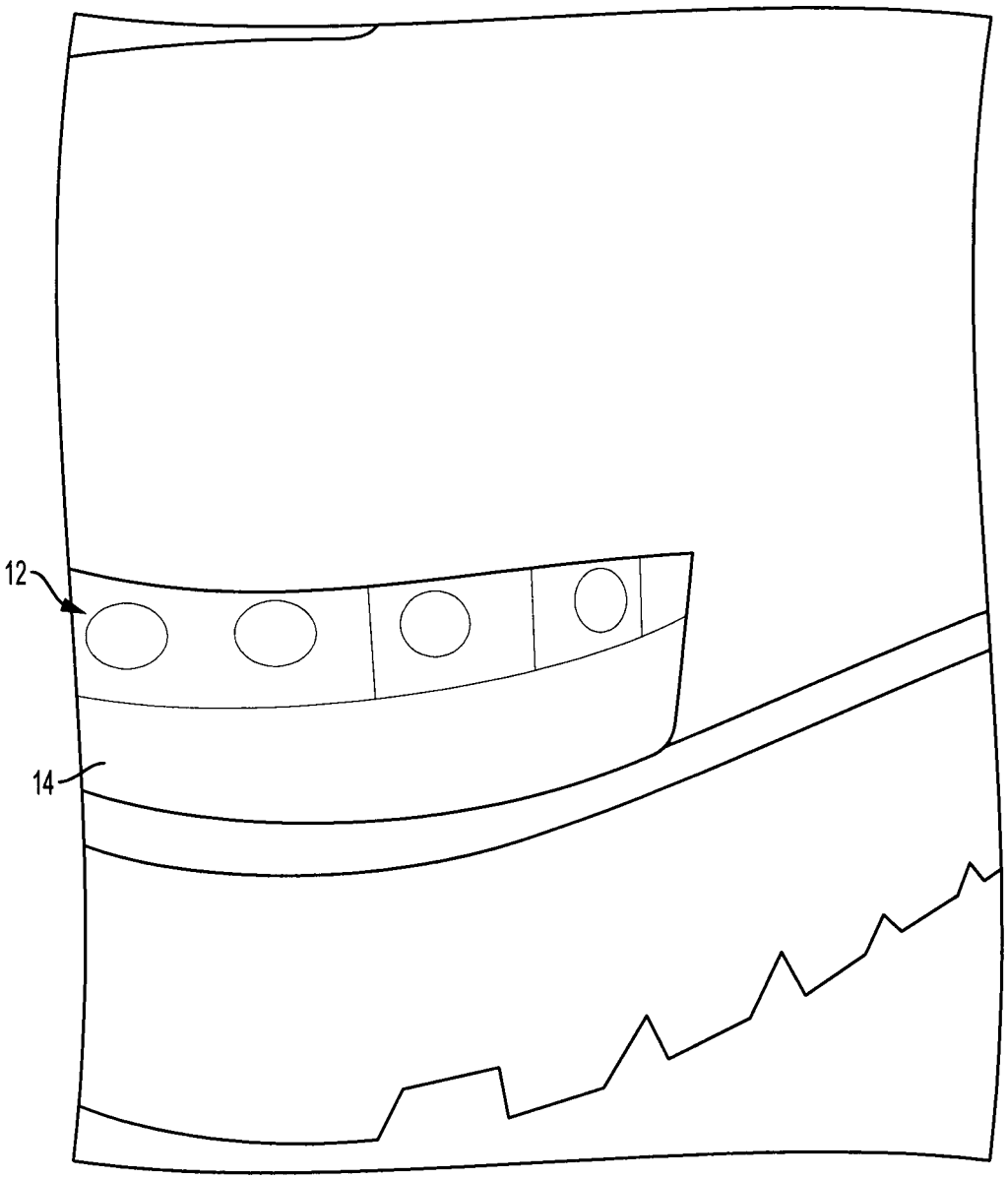
FIG. 4 is a zoomed-in view of a light source encased within a housing of an article of protective clothing according to an embodiment of the present invention.

FIG. 4 depicts a close-up view of the light source 12 encased within a housing.

As shown in FIG. 4, the article of protective clothing 10 includes a light-permeable shield 14 positioned over the encased light source 12.

In one example, the shield 14 has a thickness between about 2 millimeters and about 4 millimeters or more particularly between about 3 millimeters and about 4 millimeters. The shield 14 includes a transparent/translucent polycarbonate lens material, such as Lexan polycarbonate lens material, or other similar material as known by one of skill in the art. Also, the shield may be coated with a siloxane-based acrylate material. This coating provides thermal resistance and scratch resistance properties to the shield 14.

The shield 14 has one or more protective properties that are equal to or greater than one or more protective properties of the protective clothing 10. For example, the one or more protective properties can include water resistance, fire resistance, and impact resistance. In one example, the shield 14 protects against impact. In another example, the shield 14 is at least as heat resistant as the article of protective clothing 10 containing it.

Figure 5:
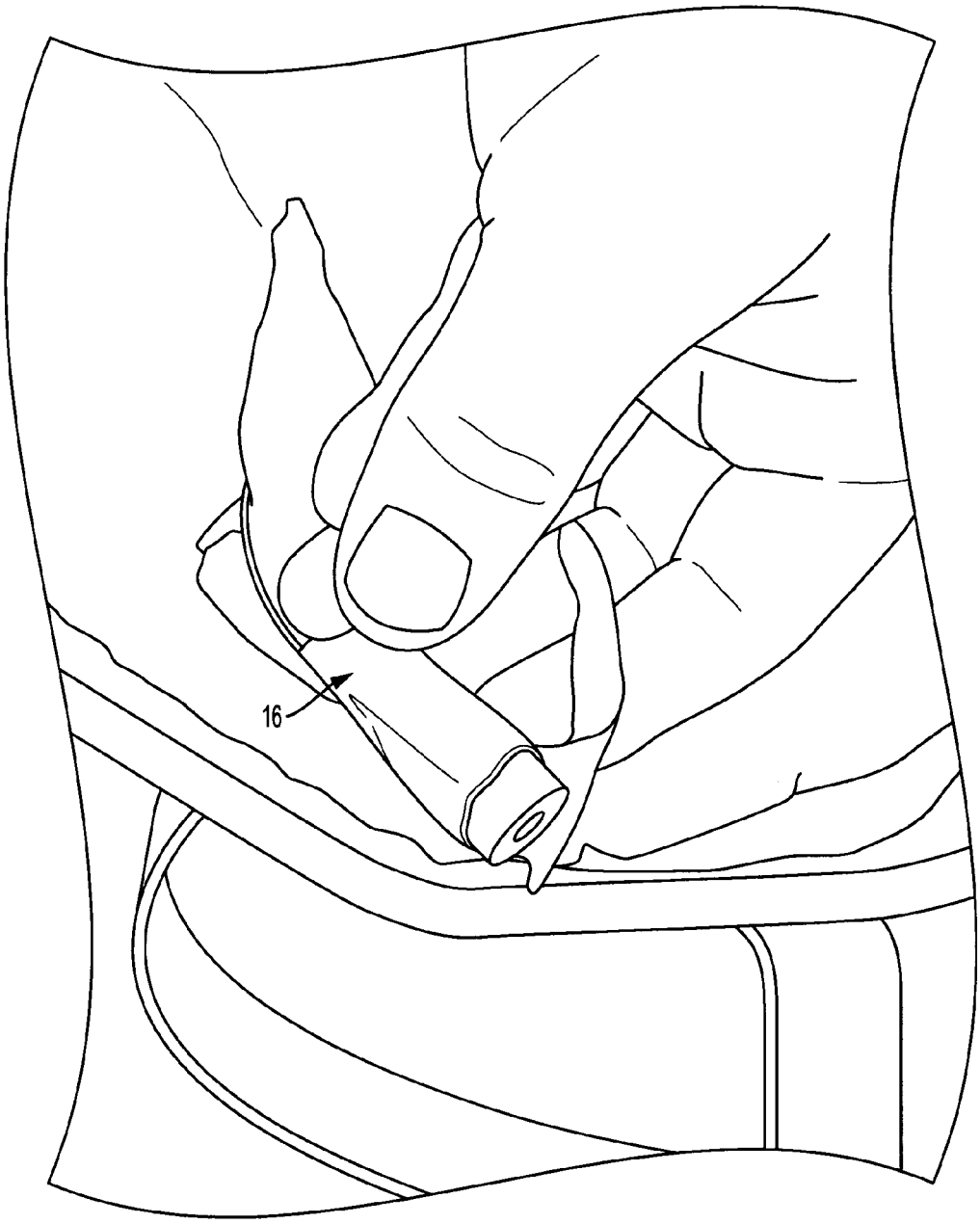
FIG. 5 is a zoomed-in view of a power source that functionally couples to the light source of an article of protective clothing according to an embodiment of the present invention.

FIG. 5 depicts a close-up view of a power source 16 that couples to the light source 12. In one example, the power source 16 is a battery. The battery can be a lithium battery such as lithium long life battery, rechargeable battery, or other type of battery as known by one of skill in the art. As shown in the FIG. 5 example, the power source 16 can be located within the article of protective clothing 10 and remote from the light source 12. In one example, the power source 16 (i.e., battery) is positioned inside a battery compartment 20, for example, a pouch at the top front of the inside of article of protective clothing 10 (i.e., boot). Wiring may be run from inside the article of protective clothing 10 (boot) between the outer protective layer of the boot and the padded inside layer of the boot.

Figure 6:
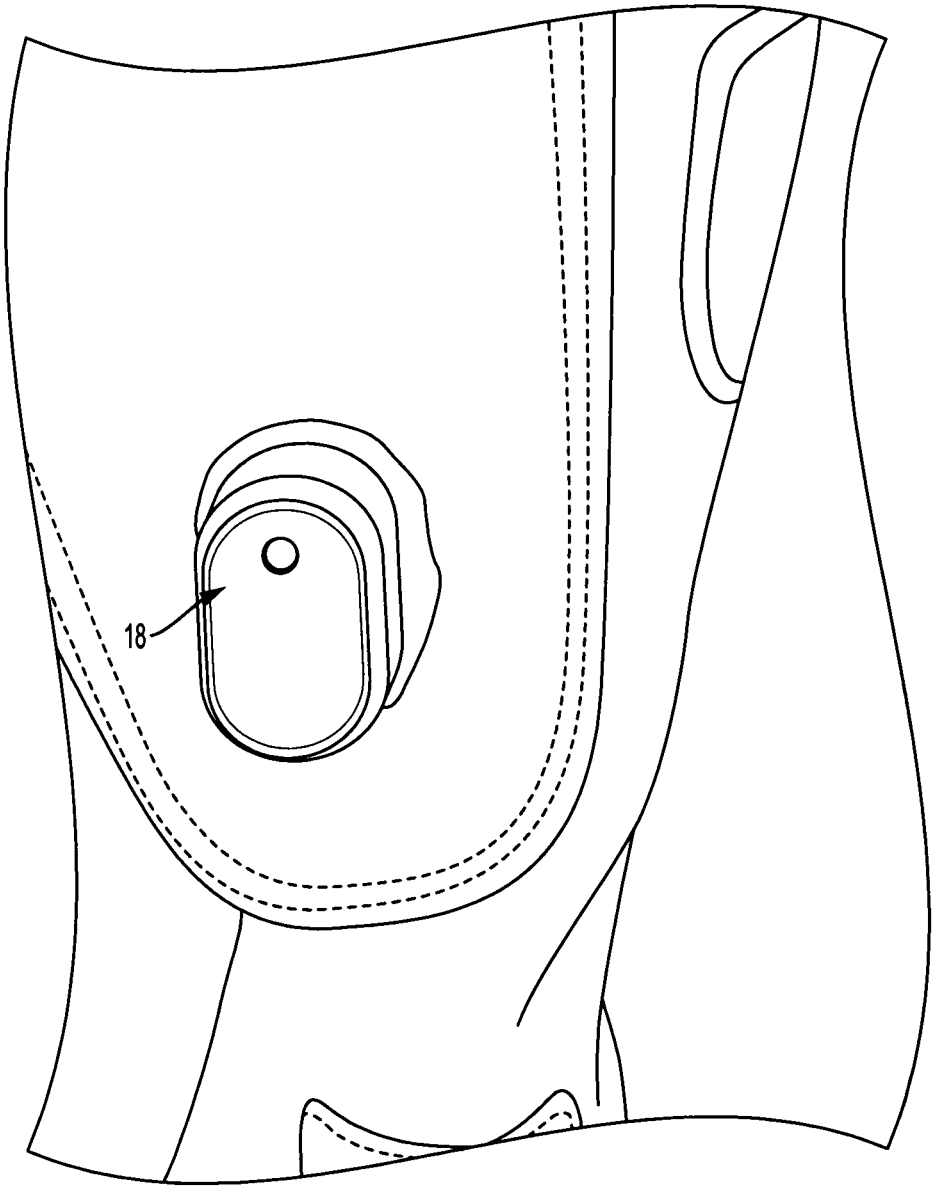
FIG. 6 is a zoomed-in view of an actuator for a power source of an article of protective clothing according to an embodiment of the present invention.
Figure 7:
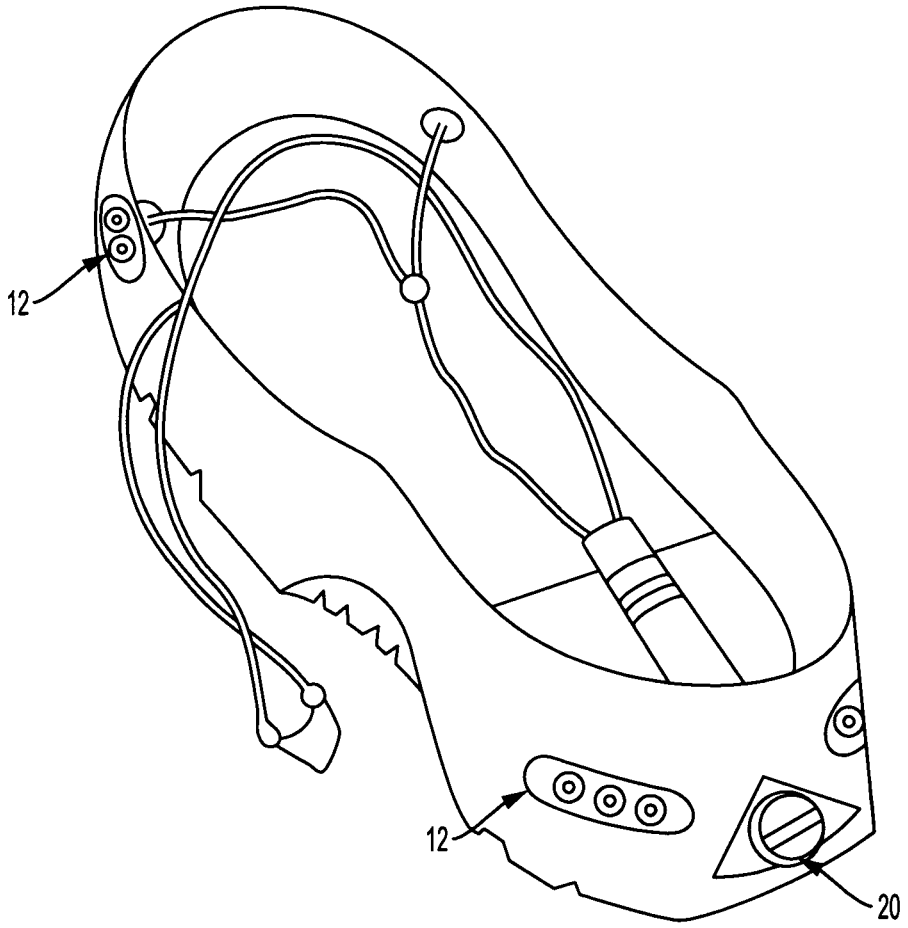
FIG. 7 is a cutaway view of a footwear sole including light emitting diodes (LEDs) and switch in the footwear sole, or wire connected to another location, components that meet NFPA 1971-8.6 standards of 500° F. for five minutes and one meter dunk test for thirty minutes, according to an embodiment of the invention.
Figure 8:
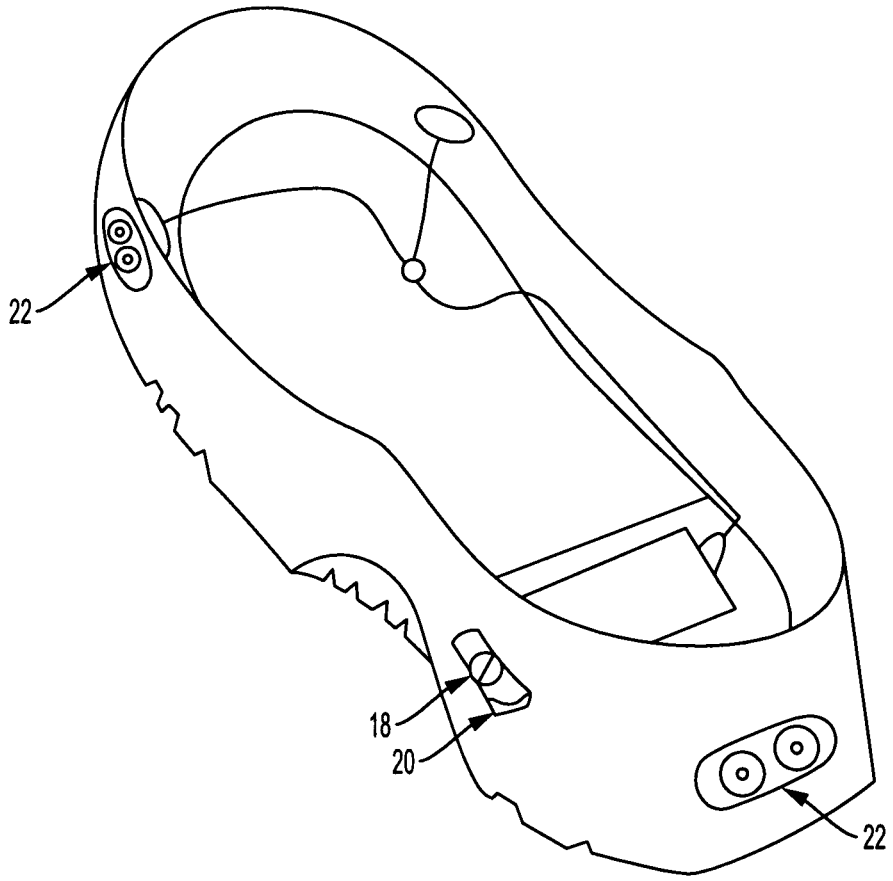
FIG. 8 is a cutaway view of a vulcanized rubber footwear sole including polycarbonate light pods, a switch, and a battery compartment, according to an embodiment of the invention.
Figure 9:
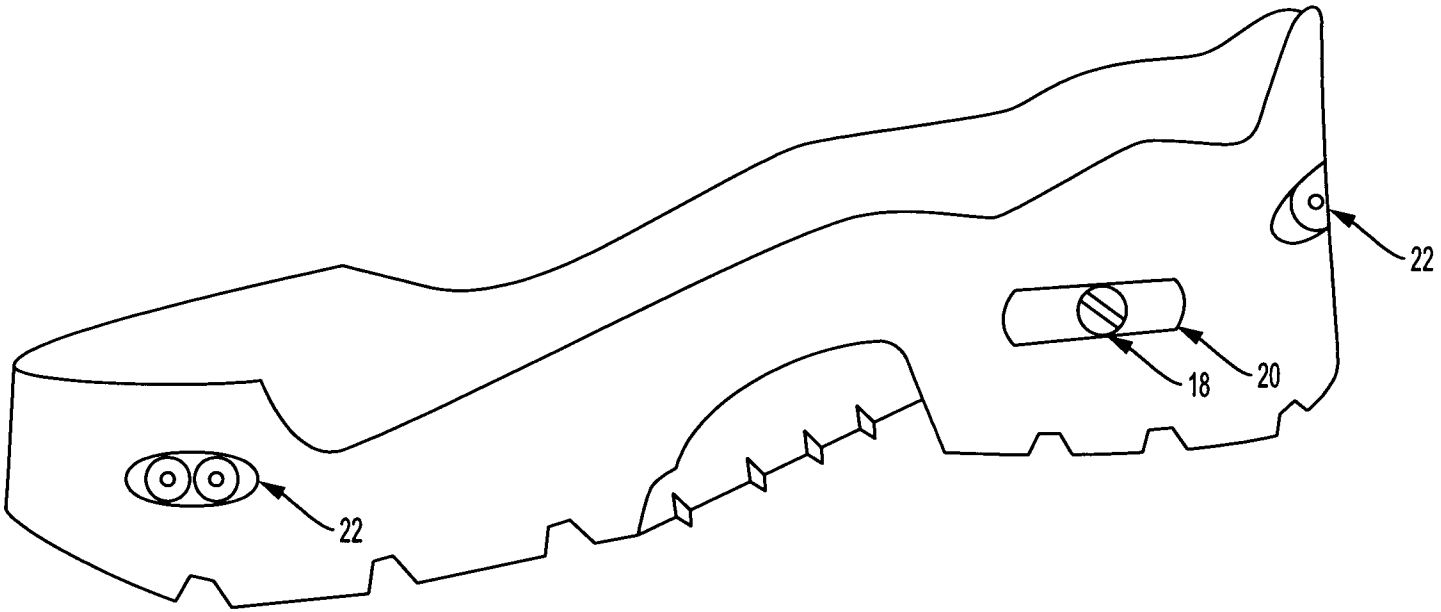
FIG. 9 is a side view of a vulcanized rubber footwear sole including polycarbonate light pods that may be removeable for replacement, switch, and battery compartment components that meet or exceed NFPA 1971-8.6 standards and testing for heat and water resistance, according to an embodiment of the invention.

FIG. 6 depicts a close-up view of an actuator 18 for a power source. The actuator 18 is also shown in FIG. 1 with respect to the article of protective clothing 10. The actuator 18 is a button/switch enabling the wearer to turn one or more light sources 12 "on" and "off." In one example, the actuator 18 is a water tight switch. In another example the actuator is a magnetic switch. In another embodiment of the present invention, the actuator can be remotely activated.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. An article of protective clothing for providing visibility of a wearer, comprising:

at least one light source encased within a housing, wherein the housing is integrated within the article of protective clothing;

a light-permeable shield positioned over the encased light source in the housing; and a power source functionally coupled to the light source;

wherein the shield has one or more protective properties equal to or greater than one or more protective properties of the protective clothing, the protective clothing at least meeting a protection standard for the one or more protective properties, and wherein the one or more protective properties comprise fire resistance.

2. The article of protective clothing of claim 1, wherein the light source emits light of at least one color.

3. The article of protective clothing of claim 1, wherein the light source emits light of more than one color.

4. The article of protective clothing of claim 1, wherein the one or more protective properties additionally comprise one or both of water resistance and impact resistance.

5. The article of protective clothing of claim 1, wherein the power source is a battery.

6. The article of protective clothing of claim 1, further comprising an actuator for the power source.

7. The article of protective clothing of claim 1, wherein the shield comprises a polycarbonate lens material.

8. The article of protective clothing of claim 1, wherein the shield has a thickness of between about 2 millimeters and about 10 millimeters.

9. The article of protective clothing of claim 1, wherein the shield is coated with a siloxane-based acrylate material.

10. The article of protective clothing of claim 1, wherein the light source is a light emitting diode (LED).

11. The article of protective clothing of claim 1, wherein the light source is a strobe light.

12. The article of protective clothing of claim 1, wherein the light source is configured to emit an amount of light of at least about 10 lumen.

13. The article of protective clothing of claim 1, wherein the light source is configured to emit an amount of light of at least about 30 lumen.

14. The article of protective clothing of claim 1, wherein the article comprises multiple light sources.

15. The article of protective clothing of claim 1, wherein the light source is located within a back section of the article of protective clothing relative to the use of the article of protective clothing.

16. The article of protective clothing of claim 1, wherein the power source is located within the article of protective clothing and remote from the light source.

17. The article of protective clothing of claim 1, wherein the article of clothing is selected from the group consisting of footwear, headwear, and outerwear.

18. The article of protective clothing of claim 1, wherein the article of clothing is a boot or shoe.

19. The article of protective clothing of claim 1, wherein the light source emits light in a temporal or spatial pattern.

20. The article of protective clothing of claim 1, wherein the light source is encased such that it is water resistant and/or watertight.

21. The article of protective clothing of claim 1, wherein the article comprises multiple encased light sources, each of which is located at an independent location.

22. The article of protective clothing of claim 2, wherein the color is selected from the group consisting of red, white, blue, green and yellow.

23. A boot for providing visibility of a wearer, comprising:

at least one light source encased within a housing, wherein the housing is integrated within the boot;

a light-permeable shield positioned over the encased light source in the housing; and a power source functionally coupled to the light source, wherein the shield has one or more protective properties equal to or greater than one or more protective properties of the boot, the boot at least meeting a protection standard for the one or more protective properties and wherein the one or more protective properties comprises fire resistance.

24. The boot of claim 23, wherein the housing is integrated within the heel of the boot.

25. The boot of claim 23, wherein the housing is integrated within the toe of the boot.

26. The boot of claim 23, wherein the boot comprises multiple light sources each encased within a housing.

27. The boot of claim 23, wherein the housing is integrated within the outsole of the boot.

28. The boot of claim 26, wherein at least one housing is integrated within the heel of the boot and at least one housing is encased within the toe of the boot.

29. A footwear outsole for providing visibility of a wearer of the footwear, said outsole comprising:

at least one light source encased within a housing, wherein the housing is integrated within the outsole and wherein the light source is functionally coupled to a power source; and a light-permeable shield positioned over the encased light source in the housing, wherein the shield has one or more protective properties equal to or greater than one or more protective properties of an article of protective fire clothing, the article of protective fire clothing at least meeting a protection standard for the one or more protective properties;

wherein the protection standard is a protection standard of the National Fire Protection Association; and wherein the one or more protective properties comprise fire resistance.

* * * * *